United States Patent [19]

Habu et al.

[11] 4,142,897

[45] Mar. 6, 1979

[54] GELATINO SILVER HALIDE PHOTOGRAPHIC MATERIAL HARDENED WITH A REACTION PRODUCT OF A VINYLSULFONYL COMPOUND AND A WATER SOLUBLE COMPOUND

[75] Inventors: Teiji Habu; Takashi Sasaki; Masahide Tamura; Shinobu Korematsu; Tsuneo Wada; Hiroki Ishii; Takayoshi Omura, all of Hino, Japan

[73] Assignee: Konishiroku Photo Industry Co., Ltd., Tokyo, Japan

[21] Appl. No.: 896,897

[22] Filed: Apr. 13, 1978

Related U.S. Application Data

[63] Continuation of Ser. No. 711,686, Aug. 4, 1976, abandoned.

[30] Foreign Application Priority Data

Aug. 9, 1975 [JP] Japan ..... 50-97090

[51] Int. Cl.[2] ..... G03C 1/30; G03C 1/76

[52] U.S. Cl. ..... 96/67; 96/111; 96/84 R; 260/117; 106/125

[58] Field of Search ..... 96/111, 67, 84 R, 109; 260/117; 106/125

[56] References Cited

U.S. PATENT DOCUMENTS

| | | | |
|---|---|---|---|
| 2,377,375 | 6/1945 | Russell | 96/109 |
| 2,739,891 | 3/1956 | Knox et al. | 96/109 |
| 2,994,611 | 8/1961 | Heyna et al. | 96/111 |
| 3,232,761 | 2/1966 | Allen et al. | 96/111 |
| 3,689,274 | 9/1972 | Sobel et al. | 96/111 |
| 4,088,495 | 5/1978 | Habu et al. | 96/111 |

*Primary Examiner*—Won H. Louie, Jr.
*Attorney, Agent, or Firm*—Haseltine, Lake & Waters

[57] ABSTRACT

Gelatin, especially in a layer of a light-sensitive silver halide photographic material, is hardened with the reaction product of a compound having at least three vinylsulfonyl groups in the molecule and a compound having at least one water-soluble group and at least one group capable of reacting with the vinylsulfonyl group, such as —SH, =NH and —$NH_2$.

10 Claims, No Drawings

GELATINO SILVER HALIDE PHOTOGRAPHIC MATERIAL HARDENED WITH A REACTION PRODUCT OF A VINYLSULFONYL COMPOUND AND A WATER SOLUBLE COMPOUND

This is a continuation of application Ser. No. 711,686 filed Aug. 4, 1976 now abandoned.

The present invention relates to a process for hardening photographic gelatin with a novel hardening agent. More particularly, the invention relates to a process for hardening photographic gelatin, which process is applicable to hardening of any gelatin-containing layer of a light-sensitive silver halide photographic material.

In general, a light-sensitive silver halide photographic material is prepared by applying various layers including, in addition to a silver halide photographic emulsion layer, a filter layer, an inter layer, a protective layer, a subbing layer, a backing layer, an anti-halation layer and the like onto a suitable support such as glass plate, paper, synthetic resin film or the like. Each of these layers is composed of a so-called gelatin film comprising gelatin as the main component. Accordingly, physical properties of any such layer composed of a gelatin film depend mainly on the physical properties of gelatin. However, gelatin per se has such properties as low melting point, high water-swellability and poor mechanical strength which are seriously undesirable when it is used in a silver halide photographic material. Accordingly, the physical properties of gelatin have heretofore been improved by reacting gelatin with various hardening agents to cause a cross-linking reaction with functional groups in the molecule of gelatin, such as amino, carboxyl and amide groups. It has long been known that inorganic hardening agents comprising polyvalent metal salts such as chromium salts and aluminum salts, for example, chromium alum and chromium trichloride and organic hardening agents such as formalin, glyoxal, acrolein and derivatives thereof can be used for hardening gelatin. These known hardening agents, however, have various photographic defects. For example, they cause high desensitization and increased fog and do not provide a practically acceptable hardening speed. Further, they inhibit the coupling property of a color coupler contained in a light-sensitive silver halide color photographic emulsion. With some hardening agents, the hardening speed is too high to produce a light-sensitive silver halide photographic material. With other hardening agents, the hardening speed is so poor that a desirable hardening effect cannot be obtained unless a sufficient time has passed. Thus, these conventional hardening agents are not satisfactory for practical purposes.

Recently, it has been required in the art to speed up the processing of a light-sensitive photographic materials. In order to meet this requirement, not only properties of the light-sensitive photographic materials per se but also properties of processing solutions have been improved so as to make them suitable for rapid processing. For example, in order to attain rapid permeation of a processing solution, the silver halide amount in a light-sensitive photographic material is increased while reducing the amount of gelatin and the thickness of the light-sensitive photographic material is reduced. However, this technique is defective in that increased fog is inevitably brought about and physical properties of films tend to be degraded. In view of the recent development of automatic processing machines, this technique is not sufficient at all, and films having a sufficient mechanical strength to resist severe mechanical friction cannot be provided by this known technique. Further, a high-temperature rapid processing using a powerful processing solution has recently been developed, and films having high physical properties and being safe from photographic deterioration due to this high-temperature rapid processing are now required. In case of color films, the color development requires a longer time than the black-and-white development, in general, the bleaching process must be conducted. In case of reversal color films, the primary development must be conducted additionally. Therefore, in the processing of color films, an especially high degree of hardening of photographic films is required.

With development and advance of rapid processing of light-sensitive photographic materials, most hardening agents heretofore regarded as being excellent have been found to be defective in various points. For example, if the amount of such known hardening agent is increased to obtain films having highly improved physical properties, such defects as desensitization, increased fog and reduced covering power are simultaneously caused.

A vinylsulfone type hardening agent has been proposed as a hardening agent in which occurrence of the above-mentioned defects is relatively reduced. Divinylsulfone has been known from old as a hardening agent of this type. This compound, however, is highly toxic to human bodies and pollutes the working environment in the manufacturing plant. Accordingly, use of this compound is not preferred. As improved vinylsulfone type hardening agents there have been proposed aromatic vinylsulfone type hardening agents as disclosed in U.S. Pat. No. 2,994,611, heterocyclic vinylsulfonylalkane type hardening agents as disclosed in U.S. Pat. No. 3,490,911 and U.S. Pat. No. 3,539,644, cyclic bis(vinyl sulfonyl)alkane type hardening agents as disclosed in U.S. Pat. No. 3,841,872 and U.S. Ser. No. 622,396, now abandoned and cyclic vinylsulfonamied and vinylsulfonylester type hardening agents as disclosed in U.S. Pat. No. 3,689,274. Most of these agents, however, cannot be used without adoption of complicated steps of dissolving them in various organic solvents and then incorporating the solutions in photographic elements, because their water-solubility is relatively low. Moreover, when large quantities of organic solvents are present in photographic elements, they often coagulate or precipitate gelatin, causing various troubles at the coating step. Still further, in case of a multi-layer film such as a color photographic emulsion film, they cause migration of ingredients among layers and color stain is readily brought about. Still in addition, when water-soluble high-boiling solvents are used, the time required for drying films is remarkably prolonged and even after drying, solvents are left in the films and cause such troubles as reduction of the film surface strength, degradation of photographic characteristics during storage and adhesion or sticking of film surfaces to each other. Moreover, use of organic solvents causes various problems as regards the safety and working environment in the manufacturing process. In view of the foregoing, it will readily be understood that it is very significant from the industrial viewpoint to provide a vinylsulfone type hardening agent which has an excellent water-solubility, does not necessitate the use of organic solvents and does not degrade photographic characteristics at all.

It has now been found that the reaction product obtained by reacting a compound having at least 3 vinylsulfonyl groups in the molecular structure with a compound having a water-soluble group and a group capable of reacting with a vinylsulfonyl group is very excellent as a gelatin-hardening agent.

As the compound having at least 3 vinylsulfonyl groups in the molecular structure (hereinafter referred to as "compound I"), there can be mentioned, for example, aromatic compounds disclosed in German Pat. No. 1,100,942, connecting hetero atom-containing alkyl compounds disclosed in Japanese Patent Publications No. 29622/69 and U.S. Pat. No. 3,490,911, sulfonamide esters disclosed in Japanese Patent Publication No. 8736/72, 1,3,5-tris(β-(vinylsulfonyl)-propionyl)-hexahydro-s-triazine disclosed in Japanese Patent Laid-Open-to-Public (Early Publication) No. 24435/74, and alkyl compounds disclosed in U.S. Ser. No. 622,396, now abandoned.

One representative class of the compounds I usable herein are those which have the general formula (I)

(I) $R(SO_2CH{=}CH_2)_m$ wherein R represents an m-valent aliphatic hydrocarbon radical which can be substituted, an m-valent phenyl radical which can be substituted or an m-valent cycloalkane radical and m is an integer of at least 3.

The preferred class of compounds I are those in which R represents an m-valent aliphatic hydrocarbon radical. The preferred species of the compounds I is that in which R represents a neopentyl radical.

Typical examples of compound I are given below without any limitation thereto:

I-1

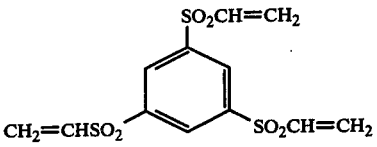

I-2

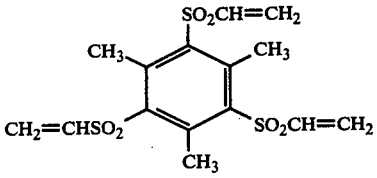

I-3

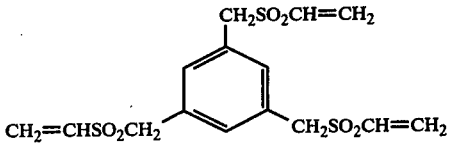

I-4 $CH_3C(CH_2OCH_2SO_2CH{=}CH_2)_3$

I-5 $C(CH_2OCH_2SO_2CH{=}CH_2)_4$

I-6 $N(CH_2CH_2OCH_2SO_2CH{=}CH_2)_3$

I-7

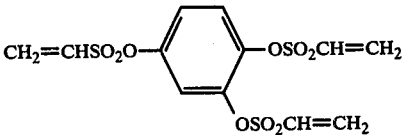

-continued

I-8

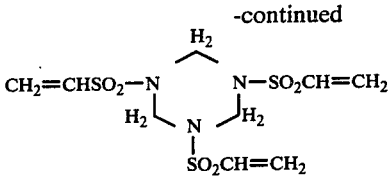

I-9 $C_2H_5C(CH_2SO_2CH{=}CH_2)_3$

I-10 $C_8H_{17}C(CH_2SO_2CH{=}CH_2)_3$

I-11 $CH_2{=}CHSO_2CH_2CH(SO_2CH{=}CH_2)CH_2SO_2CH{=}CH_2$

I-12 $(CH_2{=}CHSO_2CH_2)_3CCH_2Br$

I-13 $(CH_2{=}CHSO_2CH_2)_2CHCH(CH_2SO_2CH{=}CH_2)_2$

I-14 $(CH_2{=}CHSO_2CH_2)_3CCH_2OCH_2C(CH_2SO_2CH{=}CH_2)_3$

I-15 $C(CH_2SO_2CH{=}CH_2)_4$

I-16

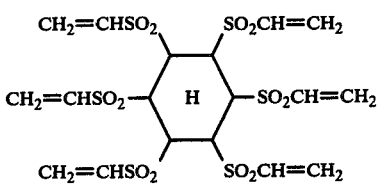

I-17 $(CH_2{=}CHSO_2CH_2)_3CCH_2SO_2CH_2CH_2Cl$

I-18

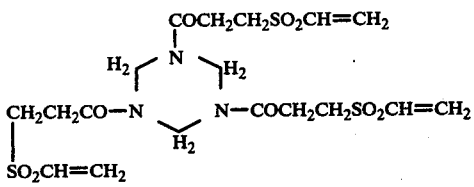

The compounds having a water-soluble group and a group capable of reacting with a vinylsulfonyl group (hereinafter referred to as "compound II"), which is usable for reaction with compound I, include those having in the molecular structure a group capable of reacting with a vinylsulfonyl group, such as —SH, =NH and $—NH_2$, and a water-soluble group such as —OH, —COOH, $—SO_3H$, $—OSO_3H$ or an alkali metal salt thereof (Na, K and Li are mentioned as the alkali metal). The compound II may contain two or more of reactive groups or water-soluble groups in the molecular structure.

One representative class of compounds II usable herein are those which have the general formula (II)

(II) $A—(CH_2)_n—B$ wherein A represents —SH or

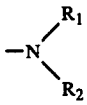

(in which $R_1$ represents a hydrogen atom and $R_2$ represents a hydrogen atom or methyl radical), B represents $—OM_1$ or $—COOM_2$ (in which $M_1$ represents hydrogen atom or $—SO_3M_2$ and $M_2$ represents a hydrogen atom or an alkali metal) and n represents 1 or 2.

The preferred class of the compounds II usable herein are those in which A represents $—NH_2$ or —SH, B represents —OH or —$COOM_1$ and $M_1$ represents a hydrogen atom or an alkali metal.

Typical examples of the compound II are as follows:

| | |
|---|---|
| II - 1 | $H_2NCOONa$ |
| II - 2 | $H_2NSO_3K$ |
| II - 3 | $HSCH_2COOH$ |
| II - 4 | $HSCH_2COON_a$ |
| II - 5 | $HSCH_2COOK$ |
| II - 6 | $HSCH_2COOLi$ |
| II - 7 | $HSCH_2CH_2COOH$ |
| II - 8 | $HSCH_2CH_2COOK$ |
| II - 9 | 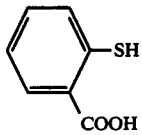 |
| II - 10 | 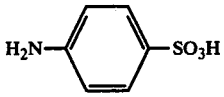 |
| II - 11 | 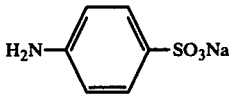 |
| II - 12 | $H_2NCH_2CH_2OH$ |
| II - 13 | $H_2NCH_2CH_2OSO_3H$ |
| II - 14 | $H_2NCH_2CH_2OSO_3K$ |
| II - 15 | $H_2NCH_2COOH$ |
| II - 16 | $H_2NCH_2COONa$ |
| II - 17 | $CH_3NHCH_2COOK$ |
| II - 18 | $H_2NCH_2SO_3H$ |
| II - 19 | $CH_3NHCH_2SO_3Na$ |
| II - 20 | $H_2NCH_2CH_2SO_3H$ |
| II - 21 | $H_2NCH_2CH_2SO_3K$ |
| II - 22 | $CH_3NHCH_2CH_2SO_3Na$ |
| II - 23 | $HN(CH_2CH_2OH)_2$ |
| II - 24 | $HN(CH_2CH_2OSO_3K)_2$ |
| II - 25 | $CH_3NHCH_2CH_2CH_2SO_3H$ |
| II - 26 | $HN(CH_2CH_2OH)(CH_2CH_2CH_2SO_3Na)$ |
| II - 27 | $C_2H_5NHCH_2CH_2CH_2CH_2SO_3H$ |
| II - 28 | $C_2H_5NHCH_2CH_2CH_2CH_2SO_3Na$ |
| II - 29 | $HN(CH_2CH_2OH)(CH_2COOH)$ |
| II - 30 | $HN(CH_2CH_2OH)(CH_2COONa)$ |
| II - 31 | $HN(CH_2COOH)_2$ |
| II - 32 | $HN(CH_2COOH)(CH_2COONa)$ |
| II - 33 | $HN(CH_2COOK)_2$ |
| II - 34 | $HSCH_2CH(OH)CH_2OH$ |
| II - 35 | $HOCH_2CH(SH)CH_2OH$ |
| II - 36 | $HN(CH_2COOK)(CH_2SO_3K)$ |
| II - 37 | $CH_3NHCH_2COONa$ |

The reaction between the compound I and the compound II can be accomplished by adding a solution of the compound II to a solution of the compound I and maintaining the mixture at room temperature or heating the mixture. When the compound II used has a free acid group as the water-soluble group, the reaction product may be further reacted with an alkali to convert the water-soluble group of the reaction product to a salt.

The mole ratio of the compounds I and II differs depending on the number of vinylsulfonyl groups of the compound I and the number of the reactive groups of the compound II. In general, when the compound I having m vinylsulfonyl groups is reacted with the compound II having one reactive group, it is preferred that the compound II be reacted in an amount of 0.5 to m moles per mole of the compound I. A hardening agent having especially desirable properties can be obtained when the compound II is reacted in an amount of 1 to (m−2) moles per mole of the compound I. The amount of the compound II to be used is also changed depending on the kind of the reactive group of the compound II. For example, if the reactive group is —SH or =NH, it is preferred that the compound II be reacted in the above-mentioned amount, and when the reactive group is —$NH_2$, it is preferred that the compound II be reacted in an amount corresponding to ½ of the above-mentioned amount.

The reaction product obtained by the reaction between the compounds I and II is a single compound in some cases, but in many cases, the reaction product is not composed of a single compound. More specifically, in many cases, the reaction product is obtained in the form of a mixture comprising as the main component a compound in which some of vinylsulfonyl groups of the compound I are consumed by the reaction with the reactive group of the compound II and containing minor amounts of the unreacted compound I and a compound in which all the vinylsulfonyl groups in the molecular structure are consumed by the reaction with the reactive group of the compound II. It is construed that the hardening effects attained in the present invention based on good water-solubility probably is ascribable to the presence of a compound in which some of vinylsulfonyl groups of the compound I are consumed by the reaction with the reactive group of the compound II but a certain number, preferably at least 2, of vinylsulfonyl groups are left in the molecular structure. If there are present minor amounts of other reaction products such as mentioned above, they do not have bad influences on the attainment of the intended effects. Therefore, it is preferred that the reaction product be used as it is obtained without isolation of the main reaction product, though the main reaction product may be isolated by chromatographic separation or similar method if necessary.

When the reaction product obtained by the above-mentioned reaction is used as a gelatin-hardening agent, it is preferably added to gelatin in the as-obtained state or after dilution with water, or in the form of an aqueous solution of a crystal or viscous liquid formed by removing the solvent from the reaction mixture.

In the instant specification, by the term "to use the reaction product as a gelatin-hardening agent" is meant to react gelatin with the reaction product in a gelatin-containing layer as one element of a light-sensitive photographic material. This reaction of gelatin with the reaction product is accomplished in various ways, for example, a method in which the reaction product as the hardening agent is added to a coating solution and the coating solution is coated and dried, a method in which a product obtained by preliminarily reacting gelatin with the hardening agent is added to a coating solution and the coating solution is then coated and dried, a method in which a coating solution containing the hardening agent is coated on a preformed layer and the resulting coating layer is then dried, a method in which a preformed layer is dipped in a solution containing the hardening agent, and a method in which a layer is dipped in a solution containing the hardening agent before or during the development.

When the reaction product is incorporated as the hardening agent into one layer of a light-sensitive silver halide photographic material, the reaction product is added in the as-obtained state or in the state dissolved in water optionally after purification as mentioned above into a coating solution for formation of said layer. It is also possible to overcoat a solution of the hardening agent after formation of such layer.

When the hardening agent of the present invention is incorporated into a coating solution for formation of a gelatin film, the amount incorporated of the hardening agent is changed depending on the kind, physical properties and photographic characteristics of the intended gelatin film. In general, the hardening agent is incorporated in an amount of 0.01 to 100% by weight, preferably 0.1 to 10% by weight, based on the gelatin in the coating solution on the dry basis. The hardening agent may be added at an optional stage of the step of preparing a coating solution for formation of the gelatin film, but when the hardening agent is added to a silver halide emulsion, it is preferred that the hardening agent be added after the chemical ripening of the silver halide emulsion.

The light-sensitive silver halide photographic material to which the present invention is applied may be any of black-and-white photographic materials, color photographic materials and pseudo-color photographic materials. Further, the present invention may be applied to light-sensitive silver halide photographic materials with various uses, for example, the photographic materials for ordinary uses, printing, X-ray photography, radiography and the like. Still further, the present invention may be applied to light-sensitive silver halide photographic materials of the negative type, the positive type and the diffusion transfer type and photographic materials according to any other photographic mechanism.

In these light-sensitive silver halide photographic materials, any of silver halides such as silver chloride, silver iodide, silver bromide, silver iodobromide, silver chlorobromide and silver chloroiodobromide can be used as a photosensitive component. Silver halide emulsions may be chemically sensitized with salts of noble metals such as ruthenium, rhodium, palladium, iridium, platinum and gold, for example, ammonium chloropalladate, potassium chloroplatinate, potassium chloropalladate and potassium chloroaurate, sulfur compounds, selenium compounds, reducing agents such as stannous salts and polyamines, and polyalkylene oxide compounds. The emulsions may be optically sensitized with cyanine dyes, merocyanine dyes and the like. Still further, the emulsions may comprise various photographic additives such as couplers, stabilizers, for example, mercury compounds, triazole compounds, azaindene compounds, benzthiazolium compounds and zinc compounds, swelling agents, for example, dihydroxyalkanes, antistatic agents, film property improving agents composed of water-dispersible fine particles of a macromolecular substance obtained by emulsion polymerization, and coating aids, for example, saponin and polyethylene glycol lauryl ether.

As the support of the light-sensitive silver halide photographic material to which the present invention is applied, there can be used, for example, films and sheets of paper, laminated paper, glass, cellulose acetate, cellulose nitrate, polyester, polyamide and polystyrene. A suitable film or sheet is chosen depending on the intended use of the photographic material.

When a gelatin film of a light-sensitive silver halide photographic material is reacted with the hardening agent of the present invention, an excellent hardening effect is obtained without degradation of photographic characteristics of the silver halide photographic emulsion such as fog and sensitivity. Further, since delayed hardening is hardly caused, a light-sensitive photographic material having excellent stability can be obtained, and even if the resulting photographic material is stored for a long period of time, the photographic emulsion is not adversely affected and a good stability is attained. Furthermore, a hard film sufficient to resist the high-temperature rapid processing and the automatic processing can be imparted to the light-sensitive photographic material.

Characteristics of the hardening process of the present invention are manifested especially when high photographic techniques are required as in the case of color photographic materials. As pointed out hereinbefore, the color development to be applied to a color photographic material requires a much longer time than the black-and-white development, and in case of the color photographic material bleaching is ordinarily conducted. Therefore, the total processing time is very long. In case of a reversal color photographic material, the primary development must be conducted additionally, and in case of an outer type reversal color photographic material, the color development wherein the coupler is present in a color developer must be repeated several times. Therefore, color photographic materials to be subjected to high-temperature processing are required to have good physical properties. According to the present invention, physical properties sufficient to resist this processing can be provided, and the film hardness is hardly changed by heat treatments or after lapse of time. Accordingly, a light-sensitive color photographic material having stable properties and being free of defects caused by excessive film hardening can be provided according to the present invention.

As another characteristic feature of light-sensitive color photographic materials, there can be mentioned a complex composition varying in a very broad range. Namely, various kinds of compounds are used. Even when the hardening process of the present invention is applied to light-sensitive color photographic materials comprising couplers such as 5-pyrazolone type magenta couplers, naphthol or phenol type cyan couplers and closed ketomethylene type yellow couplers, so-called 2-equivalent and 4-equivalent couplers derived from the foregoing couplers, and so-called masking couplers containing an arylazo group at the active point, coloring troubles such as readily observed by other hardening agents are not caused at all. Still further, the present invention is effectively applied to light-sensitive color photographic materials containing ultraviolet absorbers, fluorescent whitening agents, mordants, color developers and development inhibitor releasing compounds such as disclosed in Japanese Patent Laid-Open-to-Public (Early Publication) No. 77635/74.

Since the hardening agent of the present invention has a very high water-solubility, if it is incorporated into a conventional vinylsulfone type hardening agent having a very low water-solubility, the resulting hardening agent mixture has a highly improved water-solubility as a whole. Therefore, the hardening agent of the present invention may be used in combination with such conventional vinylsulfone type hardening agent having inferior water-solubility.

The present invention will now be described in detail by reference to the following examples that by no means limit the scope of the invention.

EXAMPLE 1

Reaction products III-1, III-2 and III-3 were prepared according to the following reactions.

Reaction Product III-1

To a solution of 3.48 g (0.01 mole) of 1,3,5-trisvinylsulfonylbenzene (compound I-1 illustrated above) in 50 ml of acetone was added a solution of 1.16 g (0.011 mole) of diethanolamine (compound II-23 illustrated above) in 50 ml of acetone, and the mixture was refluxed on a water bath for 2 hours. Insoluble substances were removed by filtration, and the filtrate was concentrated under reduced pressure to obtain a yellow viscous liquid.

Reaction Product III-2

To a solution of 5.52 g (0.01 mole) of tetrakis(vinylsulfonylmethyloxymethyl)methane (compound I-5 illustrated above) in 50 ml of acetone was added an acetone solution containing 1.56 g (0.02 mole) of thioglycolic acid (compound II-7 illustrated above), and the mixture was reacted at room temperature for 6 hours. Then, water in the same amount as the amount of acetone and 20 ml of 1N $Na_2CO_3$ were added to the reaction mixture to effect neutralization. Then, the mixture was concentrated under reduced pressure to obtain a colorless solid. Reaction Product III-3:

To a solution of 4.32 g (0.01 mole) of tetrakis(vinylsulfonylmethyl)methane (compound I-15 illustrated above) in 50 ml of acetone was added an aqueous solution containing 1.33 g (0.012 mole) of sodium sarcosine (compound II-37 illustrated above) in 70 ml of water, and the mixture was reacted under reflux for 2 hours. After completion of the reaction, acetone was evaporated under reduced pressure, and water was added to the residue so that the total volume was 283 ml. Thus, a 2% aqueous solution was obtained.

Gold and sulfur sensitizers were added to a neutral negative silver iodobromide emulsion containing 1.5 mole % of silver iodobromide, and the chemical ripening was carried out. Then, 4-hydroxy-6-methyl-1,3,3a,7-tetrazaindene as the stabilizer, diethylene glycol as the swelling agent and saponin as the coating aid were added to the emulsion. The resulting emulsion was divided into 7 portions. One portion was coated on a polyester film base and dried to form a comparative sample. The compounds I-1, I-5 and I-15 illustrated above as comparative compounds and the reaction products III-1, III-2 and III-3 of the present invention were dissolved in solvents indicated in Table 1 and incorporated into the remaining 6 portions of the emulsion, respectively. Each of the thus formed emulsions was coated on a polyester film base and dried to obtain a sample.

Table 1

| Sample No. | Compound Added | Amount Added (mole equivalent/ g gelatin) | Solvent | Amount Added (ml) of Hardening Agent Solution per 100 ml of Emulsion | Amount (g) Equivalent to 1 Mole* |
|---|---|---|---|---|---|
| 1 | — | — | — | — | — |
| 2 | III-1 | $5 \times 10^{-5}$ | water | 5.80 (2% solution) | 464 |
| 3 | III-2 | $5 \times 10^{-5}$ | water | 8.83 (2% solution) | 708 |
| 4 | III-3 | $5 \times 10^{-5}$ | water | 7.09 (2% solution) | 566 |
| 5 | I-1 | $5 \times 10^{-5}$ | dimethylformamide | 4.34 (2% solution) | 348 |
| 6 | I-5 | $5 \times 10^{-5}$ | acetone | 6.90 (2% solution) | 552 |
| 7 | I-15 | $5 \times 10^{-5}$ | acetone | 5.40 (2% solution) | 432 |

*The amount of the reaction product III formed by reacting 1 mole of the compound I with n moles of the compound II was defined as the amount equivalent to 1 mole.

Hardened film characteristics were measured with respect to each of the foregoing comparative sample and other samples. Namely, after coating and drying, the sample was stored at a temperature of 25° C. and a relative humidity of 55% for 1 day or 30 days or treated for 3 days at a relative humidity of 80% and a temperature of 50° C., and the sample was dipped in a 3% aqueous solution of sodium carbonate monohydrate maintained at 50° C. and the time required for the gelatin emulsion film to being to be dissolved in the solution was measured. Further, the sample which had been stored or treated under the above conditions was dipped in a 3% aqueous solution of sodium carbonate monohydrate maintained at 25° C. for 2 minutes, and the surface of the gelatin emulsion film was scratched with a sapphire needle having a 1 mm-diameter top and when scratches began to be formed on the surface, the load was measured as the film surface strength. Still further, after coating and drying, the sample was preserved at a temperature of 25° C. and a relative humidity of 55% for 1 day, and the sensitivity and fog were measured by sensitometry. Results of these measurements are shown in Table 2. The sensitivity is expressed in terms of the relative sensitivity determined based on the sensitivity of the comparative sample (sample No. 1) which is evaluated as 100.

Table 2

| | | Hardened Film Characteristics | | | | | | | |
|---|---|---|---|---|---|---|---|---|---|
| | | Dissolution Initiating Time (minutes) | | | Film Surface Strength (g) | | | Photographic Characteristics | |
| Sample No. | Compound Added | 1 day stored | 30 days stored | 3 days treated | 1 day stored | 30 days stored | 3 days treated | Sensitivity | Fog |
| 1 | — | 0.5 | 0.5 | 1 | 3 | 5 | 7 | 100 | 0.15 |
| 2 | III-1 | above 20 | above 20 | above 20 | 110 | 170 | 180 | 90 | 0.14 |
| 3 | III-2 | " | " | " | 110 | 170 | 190 | 93 | 0.12 |
| 4 | III-3 | " | " | " | 100 | 140 | 160 | 87 | 0.17 |

Table 2-continued

| Sample No. | Compound Added | Hardened Film Characteristics: Dissolution Initiating Time (minutes) 1 day stored | 30 days stored | 3 days treated | Film Surface Strength (g) 1 day stored | 30 days stored | 3 days treated | Photographic Characteristics: Sensitivity | Fog |
|---|---|---|---|---|---|---|---|---|---|
| 5 | I-1 | " | " | " | 130 | 190 | 210 | 93 | 0.20 |
| 6 | I-5 | " | " | " | 120 | 180 | 200 | 94 | 0.12 |
| 7 | I-15 | " | " | " | 130 | 180 | 200 | 92 | 0.13 |

Since the reaction products of the present invention have a higher water-solubility than the known comparative compounds, the addition operation can be performed very easily. Further, as will be apparent from the results shown in Table 2, the reaction products of the present invention have a very excellent hardening activity and the delayed film hardening is hardly caused even after standing still or heat treatment.

In sample No. 5 where dimethylformamide was used as the solvent, the drying property after the coating was bad and the fog was increased during storage. Further, such troubles as sticking were caused during storage. In samples Nos. 6 and 7 where acetone was used as the solvent, uneven coating was caused and no good results were obtained. In samples Nos. 2, 3 and 4 of the present invention where water was used as the solvent, none of such defects were caused.

EXAMPLE 2

Reaction product III-4 was prepared according to the following reaction.

Reaction Product III-4

To a solution of 4.32 g (0.01 mole) of tetrakis(vinylsulfonylmethyl)methane (compound I-15 illustrated above) in 50 ml of acetone was added a solution of 1.1 g (0.0075 mole) of a sodium salt of taurine (compound II-21 illustrated above) in 25 ml of water, and the mixture was reacted at 60° C. for 3 hours. Evaporation of the solvents yielded a white crystalline mass.

The following layers were formed on a cellulose acetate film base to form a multi-layer film without incorporating a hardening agent in any of these layers (comparative sample):

First Layer: anti-halation layer

Second Layer: red-sensitive silver halide emulsion layer containing a cyan coupler Third Layer: gelatinous inter layer Fourth Layer: green-sensitive silver halide emulsion layer containing a magenta coupler and a development inhibitor releasing compound disclosed in Japanese Patent Laid-Open-to-Public (Early Publication) No. 77635/74

Fifth Layer: filter layer containing yellow colloidal silver

Sixth Layer: blue-sensitive silver halide emulsion layer containing a yellow coupler Seventh Layer: gelatinous protective layer Compounds I-1 and I-15 as comparative compounds and reaction products III-1 and III-4 of the present invention were dissolved in solvents indicated in Table 3. Each film hardening agent was incorporated in respective layers in an amount of $0.5 \times 10^{-4}$ mole equivalent per g of gelatin. Hardened film characteristics were measured with respect to each of the others prepared samples to obtain results shown in Table 3. More specifically, the sample stored or heat-treated under the same conditions as described in Example 1 was dipped in a 1.5% aqueous solution of sodium hydroxide maintained at 50° C. and the time required for the film to begin to be dissolved in the solution was measured. Separately, the sample was dipped in a 3% aqueous solution of sodium carbonate monohydrate maintained at 25° C. for 2 minutes and the surface was scratched with a sapphire needle having a 1 mm diameter-point and when scratches began to be formed on the film surface, the load was measured as the film surface strength. The results obtained are shown in Table 3.

The sample was subjected to white light wedge exposure and then subjected to color development treatment at 38° C. for 3 minutes with a liquid color developer containing as the main ingredient 4-amino-3-methyl-N-ethylhydroxyethylaniline sulfate. Then, the sample was subjected to bleaching, fixing and water washing treatments according to customary procedures and photographic characteristics were determined according to sensitometry, to obtain the results shown in Table 3. The sensitivity is expressed in terms of the relative sensitivity determined based on the sensitivity of the comparative sample (sample No. 8) measured by sensitometry through a filter indicated in Table 3, which is evaluated as 100. In Table 3, B, G and R denote that the color densities were measured through blue, green and red filters, respectively, and the sensitometry was then conducted.

Table 3

| Sample No. | Compound Added | Hardened Film Characteristics: Dissolution Initiating Time (minutes) 1 day stored | 30 days stored | 3 days treated | Film Surface Strength (g) 1 day stored | 30 days stored | 3 days treated |
|---|---|---|---|---|---|---|---|
| 8 | — | 0.5 | 0.5 | 0.5 | 2 | 6 | 8 |
| 9 | III-1 | above 20 | above 20 | above 20 | 140 | 220 | 230 |
| 10 | III-4 | " | " | " | 150 | 210 | 230 |
| 11 | I-1 | " | " | " | 160 | 240 | 260 |
| 12 | I-15 | " | " | " | 160 | 220 | 250 |

| Sample No. | Photographic Characteristics: Sensitivity B | G | R | Fog B | G | R | Solvent |
|---|---|---|---|---|---|---|---|
| 8 | 100 | 100 | 100 | 0.10 | 0.10 | 0.10 | — |
| 9 | 94 | 92 | 88 | 0.08 | 0.08 | 0.13 | water |
| 10 | 95 | 95 | 93 | 0.07 | 0.08 | 0.12 | water |

Table 3-continued

| | | | | | | | |
|---|---|---|---|---|---|---|---|
| 11 | 93 | 91 | 88 | 0.12 | 0.12 | 0.19 | dimethylformamide |
| 12 | 94 | 95 | 93 | 0.07 | 0.07 | 0.12 | acetone |

As will be apparent from the results shown in Table 3, the reaction product of the present invention is well dissolved in water and when it is applied to a multilayer color film, an excellent hardening effect can be obtained without degradation of photographic characteristics.

Although samples Nos. 11 and 12 gave relatively good results with respect to the hardening effect, since they had to be added by using an organic solvent, various defects owing to the use of solvents, such as described in Example 1, were similarly observed. Especially in case of sample No. 11 in which dimethylformamide was used, fogs were formed and color stain was caused.

Samples Nos. 8, 9 and 10 were subjected to the reversal color processing (primary development, water washing, reversal exposure, secondary development, water washing, bleaching, water washing, fixing and water washing). Although the film surface was considerably damaged in sample No. 8, good film conditions were attained in samples Nos. 9 and 10 and photographic characteristics were not particularly degraded.

EXAMPLE 3

Reaction products III-5 and III-6 were prepared according to the following reactions. Reaction Product III-5:

To a solution of 4.32 g (0.01 mole) of tetrakis(vinylsulfonylmethyl)methane (compound I-15 illustrated above) in 50 ml of acetone was added a solution of 1.57 g (0.015 mole) of diethanolamine (compound II-23 illustrated above) in 50 ml of acetone, and the mixture was refluxed on a water bath for 2 hours. The reaction mixture was filtered, and the filtrate was concentrated under reduced pressure to obtain a viscous liquid.

Reaction Product III-6

To a solution of 3.56 g (0.01 mole) of 1,1,1-tris(vinylsulfonylmethyl)propane (compound I-9 illustrated above) in 50 ml of acetone was added an aquesous solution containing 0.97 g (0.01 mole) of a sodium salt of glycine (compound II-16 illustrated above) in 50 ml of water, and the mixture was reacted at 50° C. on a warm water bath for 2 hours. Acetone was distilled under reduced pressure and water was added to the residue until the volume was 227 ml. Thus, a 2% solution was prepared.

Gold and sulfur sensitizers were added to a gelatin emulsion of silver chlorobromide containing 30 mole % of silver bromide and the chemical ripening was conducted. Then, a stabilizer, a coating aid and a magenta coupler were added to the emulsion, and the emulsion was divided into 5 portions. One portion was directly coated on a polyethylene-laminated paper and dried to obtan a comparative sample free of a hardening agent. Compounds I-9 and I-15 as comparative compounds and reaction products III-5 and III-6 of the present invention were dissolved in solvents indicated in Table 4 and incorporated into the remaining 4 portions of the emulsion, respectively, in an amount of $10^{-4}$ mole equivalent per g of gelatin. The emulsions were coated on polyethylene-laminated papers and dried. Thus were prepared four samples each containing a hardening agent. With respect to each sample, the hardened film characteristics were measured according to the method described in Example 2. Further, each sample was subjected to the color development at 30° C. for 3 minutes and 30 seconds with a liquid color developer comprising as the main ingredient 3-methyl-N-ethyl-β-methanesulfonamidoethyl-4-aminoaniline sulfate, and then, the sample was subjected to bleaching-fixing and water washing treatments and photographic characteristics were determined by sensitometry. Obtained results are shown in Table 4. The sensitometry was conducted based on the reflection density measured through a green filter. The sensitivity is expressed in terms of the relative sensitivity determined based on the sensitivity of the comparative sample (sample No. 13) which is evaluated as 100.

Table 4

| | | Hardened Film Characteristics | | | | | | | | |
|---|---|---|---|---|---|---|---|---|---|---|
| | | Dissolution Initiating Time (minutes) | | | Film Surface Strength (g) | | | Photographic Characteristics | | |
| Sample No. | Compound Added | 1 day stored | 30 days stored | 3 days treated | 1 day stored | 30 days stored | 3 days treated | Sensitivity | Fog | Solvent |
| 13 | — | 0.5 | 0.5 | 1 | 1 | 1 | 2 | 100 | 0.05 | — |
| 14 | III-5 | 16 | above 20 | above 20 | 90 | 130 | 150 | 97 | 0.04 | water |
| 15 | III-6 | 18 | " | " | 80 | 130 | 150 | 97 | 0.04 | water |
| 16 | I-9 | 18 | " | " | 90 | 140 | 160 | 95 | 0.04 | hexamethyl phosphoric triamide |
| 17 | I-15 | 18 | " | " | 110 | 150 | 170 | 97 | 0.04 | acetone |

As will readily be understood from the results shown in Table 4, the reaction product of the present invention is well dissolved in water and has a film-hardening activity comparable to that of known similar compounds without substantial degradation of photographic characteristics.

In samples Nos. 16 and 17 formed by adding comparative compounds in the state dissolved in organic solvents, it was found that various defects owing to the use of organic solvents, such as described in Example 1, were similarly caused. Especially in sample No. 16 formed by using hexamethyl phosphoric triamide, bleaching out was caused by the solvent and it could not be put into practical use as a photographic material.

What we claim is:

1. A light-sensitive silver halide photographic material comprising a support and at least a gelatin-containing layer coated thereon which contains gelatin having been hardened with a product containing at least 2 vinylsulfonyl groups obtained by reacting in solution at a temperature ranging from room temperature to the reflux temperature of the solution a compound (A)

having at least 3 vinylsulfonyl groups in the molecular structure with a compound (B) having at least one water-soluble group and at least one group capable of reacting with the vinylsulfonyl group in the molecular structure, wherein said compound (A) is defined by formula (I)

(I) $R(SO_2CH{=}CH_2)_m$ wherein R represents an m-valent acyclic aliphatic hydrocarbon radical which may be substituted, an m-valent phenyl radical which may be substituted or an m-valent cyclohexane radical and m represents an integer of 3 to 6 and wherein in said compound (B) the group capable of reacting with the vinylsulfonyl group, is selected from the group consisting of —SH, =NH and $—NH_2$ and the water soluble group is selected from the group consisting of —OH, —COOH, $—SO_3H$, $—O-SO_3H$ and the alkali metal salts thereof, compound (B) being reacted in an amount of 1 to (m−2) moles per mole of compound (A) when the group capable of reacting with the vinylsulfonyl group is —SH or =NH and in an amount of ½ to ½ (m−2) moles per mole of compound (A) when the group capable of reacting with the vinylsulfonyl group is $—NH_2$.

2. The light-sensitive silver halide photographic material as claimed in claim 1 wherein said compound (B) is defined by formula (II)

(II) $A—(CH_2)_n—B$ wherein A represents —SH or

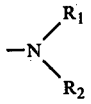

in which $R_1$ represents a hydrogen atom and $R_2$ represents a hydrogen atom or a methyl radical, B represents said water soluble group, and n represents 1 or 2.

3. The light-sensitive silver halide photographic material as claimed in claim 2 wherein $R_1$ and $R_2$ represent a hydrogen atom.

4. The light-sensitive silver halide photographic material as claimed in claim 3, wherein R represents a neopentyl radical.

5. The light-sensitive silver halide photographic material as claimed in claim 1, wherein the gelatin-containing layer is a layer selected from the group consisting of a silver halide emulsion layer, a protective layer, an inter layer, a filter layer, an anti-halation layer, a backing layer and a subbing layer.

6. The light-sensitive silver halide photographic material as claimed in claim 5, wherein the gelatin-containing layer is a layer selected from the consisting of a silver halide emulsion layer and a protective layer.

7. The light-sensitive silver halide photographic material as claimed in claim 6, wherein the gelatin-containing layer is a protective layer.

8. The light-sensitive silver halide photographic material as claimed in claim 1, wherein R represents an m-valent acyclic aliphatic hydrocarbon radical.

9. The light-sensitive silver halide photographic material as claimed in claim 8, wherein R represents a neopentyl radical.

10. A light-sensitive silver halide photographic material comprising a support and at least a gelatin-containing layer coated thereon which contains gelatin having been hardened with a product containing at least 2 vinylsulfonyl groups obtained by reacting in solution at a temperature ranging from room temperature to the reflux temperature of the solution a compound (A) having at least 3 vinylsulfonyl groups in the molecular structure with a compound (B) having at least one water-soluble group and at least one group capable of reacting with the vinylsulfonyl group in the molecular structure wherein compound (A) is selected from the group consisting of

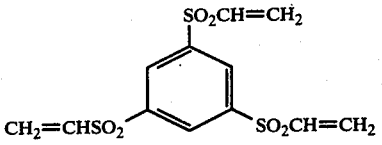

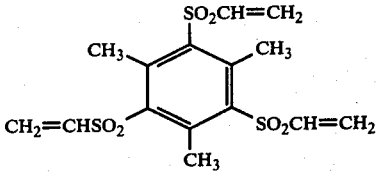

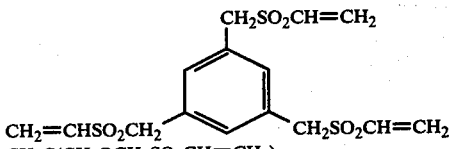

$CH_3C(CH_2OCH_2SO_2CH{=}CH_2)_3$
$C(CH_2OCH_2SO_2CH{=}CH_2)_4$
$N(CH_2CH_2OCH_2SO_2CH{=}CH_2)_3$

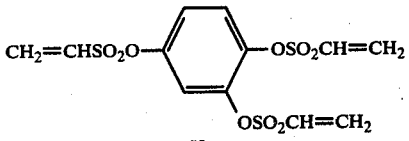

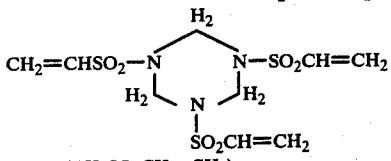

$C_2H_5C(CH_2SO_2CH{=}CH_2)_3$
$C_8H_{17}C(CH_2SO_2CH{=}CH_2)_3$

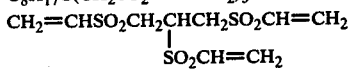

$(CH_2{=}CHSO_2CH_2)_3CCH_2Br$
$(CH_2{=}CHSO_2CH_2)_2CHCH(CH_2SO_2CH{=}CH_2)_2$
$(CH_2{=}CHSO_2CH_2)_3CCH_2OCH_2C(CH_2SO_2CH{=}CH_2)_3$
$C(CH_2SO_2CH{=}CH_2)_4$

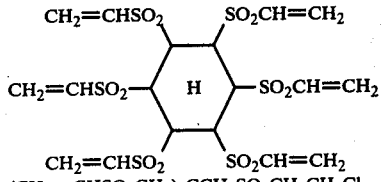

$(CH_2{=}CHSO_2CH_2)_3CCH_2SO_2CH_2CH_2Cl$ and

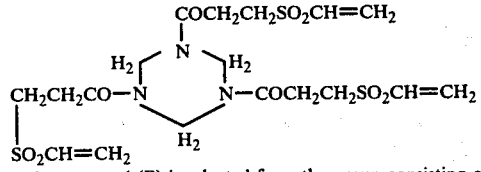

and compound (B) is selected from the group consisting of
$H_2NCOONa$
$H_2NSO_3K$
$HSCH_2COOH$ -continued $HSCH_2COOH_a$
$HSCH_2COOK$
$HSCH_2COOLi$
$HSCH_2CH_2COOH$
$HSCH_2CH_2COOK$

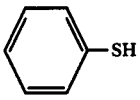

COOH

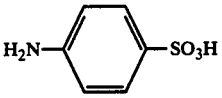

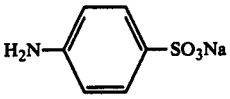

$H_2NCH_2CH_2OH$
$H_2NCH_2CH_2OSO_3H$
$H_2NCH_2CH_2OSO_3K$
$H_2NCH_2COOH$
$H_2NCH_2COONa$
$CH_3NHCH_2COOK$
$H_2NCH_2SO_3H$
$CH_3NHCH_2SO_3Na$
$H_2NCH_2CH_2SO_3H$
$H_2NCH_2CH_2SO_3K$
$CH_3NHCH_2CH_2SO_3Na$
$HN(CH_2CH_2OH)_2$
$HN(CH_2CH_2OSO_3K)_2$
$CH_3NHCH_2CH_2CH_2SO_3H$

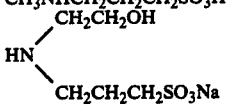

$C_2H_5NHCH_2CH_2CH_2CH_2SO_3H$

-continued $C_2H_5NHCH_2CH_2CH_2CH_2SO_3Na$

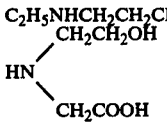

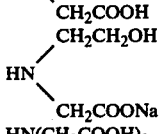

$HN(CH_2COOH)_2$

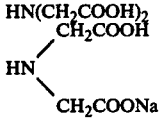

$HN(CH_2COOK)_2$

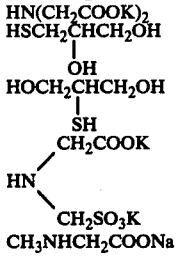

$CH_3NHCH_2COONa$ and compound (B) being reacted in an amount of 1 to (m−2) moles per mole of compound (A), when compound (B) contains an —SH or =NH group and in an amount of ½ to ½ (m−2) moles per mole of compound (A), when compound (B) contains an $—NH_2$ group, m being the number of vinylsulfonyl groups in compound (A).

* * * * *